US009322227B2

(12) United States Patent
Simpson et al.

(10) Patent No.: US 9,322,227 B2
(45) **Date of Patent: *Apr. 26, 2016**

(54) RADIALLY EXPANDABLE STABILIZER

(71) Applicant: SMITH INTERNATIONAL, INC., Houston, TX (US)

(72) Inventors: James A. Simpson, Mount Vernon, AR (US); Ronald G. Schmidt, Tomball, TX (US); Charles H. Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/530,241

(22) Filed: Oct. 31, 2014

(65) Prior Publication Data

US 2015/0053391 A1 Feb. 26, 2015

Related U.S. Application Data

(63) Continuation of application No. 13/218,159, filed on Aug. 25, 2011, now Pat. No. 8,887,798.

(51) Int. Cl.

| | |
|---|---|
| ***E21B 43/11*** | (2006.01) |
| ***E21B 17/10*** | (2006.01) |
| ***E21B 23/01*** | (2006.01) |
| ***E21B 29/00*** | (2006.01) |

(52) U.S. Cl.

CPC ..... *E21B 17/1014* (2013.01); *E21B 23/01* (2013.01); *E21B 29/002* (2013.01)

(58) Field of Classification Search

CPC ... E21B 29/00; E21B 29/005; E21B 17/1014; E21B 29/002; E21B 23/01

USPC ..... 166/241.3, 55.7

See application file for complete search history.

(56) References Cited

U.S. PATENT DOCUMENTS

| | | | | |
|---|---|---|---|---|
| 3,098,534 | A | 7/1963 | Carr et al. | |
| 3,370,657 | A | 2/1968 | Antle | |
| 3,376,927 | A * | 4/1968 | Brown | 166/361 |
| 3,489,211 | A | 1/1970 | Kammerer | |
| 4,776,394 | A | 10/1988 | Lynde et al. | |
| 4,834,185 | A * | 5/1989 | Braddick | 166/382 |

(Continued)

FOREIGN PATENT DOCUMENTS

CN 2844399 Y 12/2006

OTHER PUBLICATIONS

International Search Report and Written Opinion of the ISA; dated Jan. 18, 2013; PCT/US2012/052201, 10 pages.

(Continued)

*Primary Examiner* — Kenneth L Thompson
*Assistant Examiner* — Michael Wills, III

(57) ABSTRACT

A downhole tool includes a radial expansion assembly deployed about, and configured to rotate substantially freely with respect to, a tool mandrel. The expansion assembly includes at least one stabilizer block configured to extend radially outward from the mandrel into contact with a wellbore casing string. When deployed between uphole and downhole cones, the stabilizer block includes a plurality of angled splines configured to engage corresponding splines on the cones. Relative axial motion between the stabilizer block and the cones causes a corresponding radial extension or retraction of the stabilizer block.

20 Claims, 5 Drawing Sheets

(56) References Cited

U.S. PATENT DOCUMENTS

| | | | |
|---|---|---|---|
| 4,842,082 | A | 6/1989 | Springer |
| 5,150,755 | A | 9/1992 | Cassel et al. |
| 5,265,675 | A | 11/1993 | Hearn et al. |
| 5,456,312 | A | 10/1995 | Lynde et al. |
| 5,732,770 | A | 3/1998 | Beeman |
| 5,836,406 | A | 11/1998 | Schuh |
| 6,241,017 | B1 | 6/2001 | Doane et al. |
| 6,453,998 | B1 | 9/2002 | Reeve |
| 6,679,328 | B2 | 1/2004 | Davis et al. |
| 6,935,423 | B2 | 8/2005 | Kusmer |
| 7,178,589 | B2 | 2/2007 | Campbell et al. |
| 7,377,328 | B2 | 5/2008 | Dewey et al. |
| 7,448,446 | B2 | 11/2008 | Campbell et al. |
| 7,493,971 | B2 | 2/2009 | Nevlud |
| 7,891,441 | B2 | 2/2011 | Lee |
| 8,887,798 | B2 | 11/2014 | Simson et al. |
| 2005/0194151 | A1 | 9/2005 | Dewey et al. |
| 2006/0207797 | A1 | 9/2006 | Dewey et al. |
| 2007/0181298 | A1 | 8/2007 | Sheiretov et al. |
| 2010/0288491 | A1 | 11/2010 | Cochran et al. |
| 2012/0325480 | A1 | 12/2012 | Schmidt et al. |
| 2013/0048287 | A1 | 2/2013 | Simson et al. |

OTHER PUBLICATIONS

European Search Report issued in related EP application 12825557.7 on Feb. 16, 2016, 3 pages.

* cited by examiner

RADIALLY EXPANDABLE STABILIZER

CROSS-REFERENCE TO RELATED APPLICATIONS

This application is a continuation of U.S. patent application Ser. No. 13/218,159, filed Aug. 25, 2011 and titled "HYDRAULIC STABILIZER FOR USE WITH A DOWNHOLE CASING CUTTER," which application is expressly incorporated herein by this reference in its entirety.

BACKGROUND

Oil and gas wells are ordinarily completed by first cementing metallic casing stringers in the borehole. During the drilling, completion, and production phase, operators often find it useful to perform various remedial work, repair, or other maintenance in the casing string. For example, it is sometimes useful to cut and remove a section of a tubing string or well casing. During a typical cutting operation, it is generally desirable to stabilize the cutting tool so as to improve the efficiency of the cutting operation. Those of ordinary skill in the art will readily appreciate that improved efficiency results in a reduction of time and therefore a cost savings.

Numerous stabilizing and/or centralizing mechanisms are known in the art for use in downhole operations including drilling and workover operations. Such stabilizing mechanisms include, for example, mechanically and hydraulically actuated toggle mechanisms, spring actuated mechanisms, hydraulically actuated cam-driven or cone-driven mechanisms, hydraulically actuated piston mechanisms, as well as standard fixed blade stabilizing mechanisms. While various stabilizing mechanisms have been widely used in downhole operations, they are often not well suited for certain casing cutting operations.

For example, toggle mechanisms do not provide consistent stabilizing force. Toggle mechanisms are also prone to failure in service. Spring mechanisms are not well suited for cutting operations in that they tend to allow radial movement of the stabilized assembly which can negate (or partially negate) the stabilization. Radial piston assemblies, while capable of providing a suitable stabilizing force, are prone to catastrophic seal failure and tend to have geometric constraints. Moreover, piston mechanisms can damage the casing owing to the application of too much radial force. Cam-driven and cone-driven mechanisms also tend to be limited by geometric constraints, in particular by the amount of radial stroke that can be generated within a downhole assembly. Fixed blade (passive) stabilizers, commonly utilized in drilling operations, allow the axial translation, but do not generally provide adequate radial stabilization, especially as the blades wear over time. In particular, passive stabilizers have a built-in radial clearance that wears with time and allows for radial movement (and therefore vibration and oscillation that tends to reduce cutting efficiency and damage cutting tools). Hydraulic stabilization mechanisms may provide suitable radial stabilization but tend to have excessive clamping forces that do not allow for axial translation of the cutting tool during the cutting operation.

SUMMARY

In one example embodiment of the present disclosure, a downhole radial stabilizer is provided for use in casing cutting operations. The stabilizer includes a radial expansion assembly deployed about and configured to rotate substantially freely with respect to a tool mandrel. The radial expansion assembly includes at least one stabilizer block configured to extend radially outward from the mandrel into contact with a wellbore casing string. The stabilizer block may be deployed between uphole and downhole cones and includes a plurality of angled splines configured to engage corresponding splines in the cones. As such, relative axial motion between the stabilizer block and the cones causes a corresponding radial extension or retraction of the block. The stabilizer block is hydraulically actuated.

Example embodiments disclose several technical features. For example, one or more embodiments of the present disclosure provide for improved radial stabilization as compared to passive stabilizers and therefore tend to improve the efficiency and reliability of casing cutting operations. Additional features can include a reduction in the time to complete the cutting operation and a reduction in cutter wear. Example stabilizer embodiments in accordance with the present disclosure may also be configured to provide for axial slippage (translation) during the casing cutting operation while at the same time providing suitable radial stabilization. Such axial slippage is highly useful when the stabilizer is used in combination with a wing-type casing cutter.

An embodiment of the present disclosure includes a downhole stabilizer. The downhole stabilizer further includes a tool body configured for coupling with a downhole tool string. The tool body is arranged and designed, or otherwise configured, with an axial through bore and a mandrel. A first cone is deployed about the mandrel and includes at least one first cone recess having a set of first cone splines in at least one axial wall of the first cone recess. A second cone is deployed about the mandrel and includes at least one second cone recess having a set of second cone splines in at least one axial wall of the second cone recess. At least one stabilizer block is deployed axially between the first and second cones and is carried in the first and second recesses. The stabilizer block includes at least two sets of stabilizer block splines on at least one lateral face/side thereof. A first of the sets of stabilizer block splines compliments and engages the set of first cone splines and a second of the sets of stabilizer block splines compliments and engages the set of second cone splines. The sets of first cone, second cone and stabilizer block splines are angled with respect to a longitudinal axis of the tool body such that axial translation of the second cone with respect to the first cone either radially extends or retracts the stabilizer block. In another embodiment of the present disclosure, a string of downhole tools, e.g., a casing cutting tool and the aforementioned stabilizer, may be provided.

The foregoing has outlined rather broadly the features and technical aspects of one or more embodiments of the present disclosure in order that the detailed description that follows may be better understood. Additional features and aspects of embodiments of the present disclosure will be described hereinafter which form the subject of at least some of the claims. It should be appreciated by those skilled in the art that the conception and the specific embodiments disclosed may be readily utilized as a basis for modifying or designing other structures for carrying out the same purposes of the embodiments disclosed herein. It should also be realized by those skilled in the art that such equivalent constructions do not depart from the spirit and scope of the present disclosure.

BRIEF DESCRIPTION OF THE DRAWINGS

For a more complete understanding of embodiments of the present disclosure, reference is now made to the following descriptions taken in conjunction with the accompanying drawings, in which.

DETAILED DESCRIPTION

Figure 1:
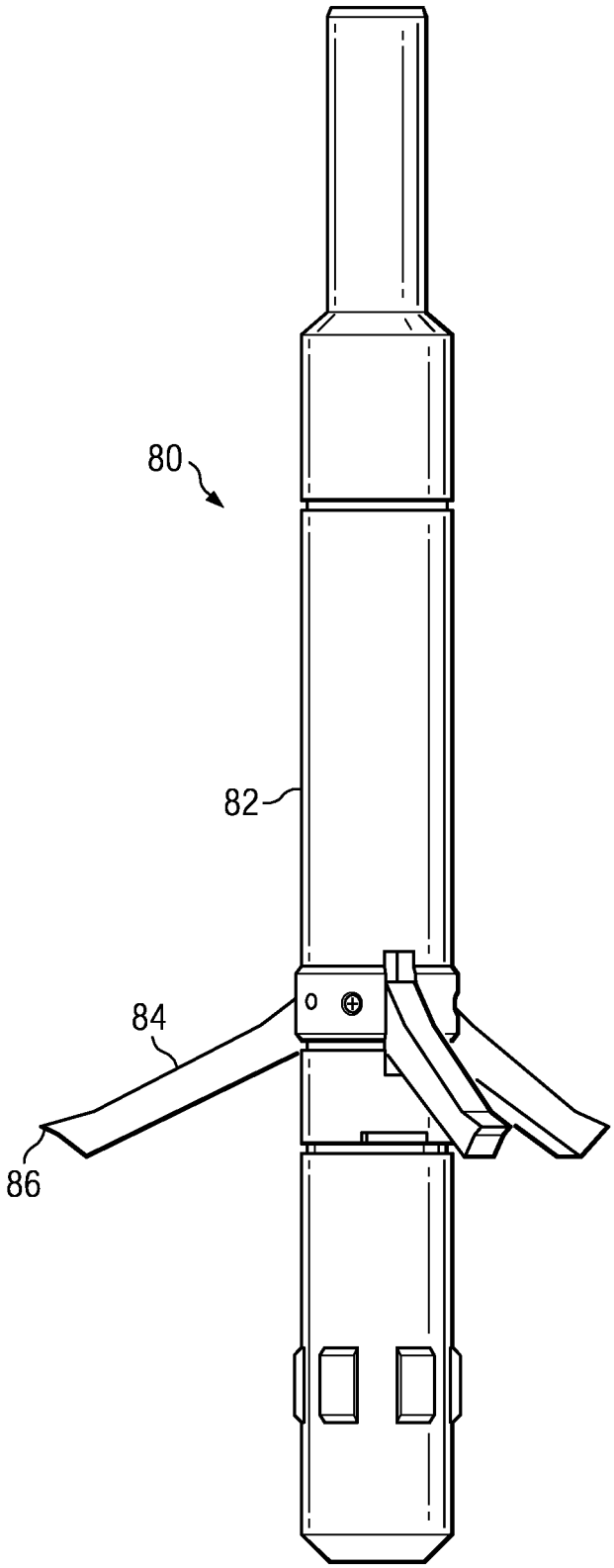
FIG. 1 (PRIOR ART)
FIG. 1 depicts one example prior art casing cutter tool suitable for use in the tool string depicted on FIG. 2.

FIG. 1 depicts an example of a prior art casing cutting tool 80 suitable for use in a tool string. Casing cutting tool 80 includes a plurality of circumferentially spaced cutting arms 84 deployed on a tool body 82. Tool 80 is commonly referred to in the art as a hinge-type cutter or a wing-type cutter as the cutting arms 84 are connected to the tool body 82 via a hinge-like joint. During a typical cutting operation, the tool string and the tool 80 are rotated in the wellbore thereby urging the cutting arms 84 radially outward (e.g., via hydraulic actuation) such that the cutting tips 86 engage the wellbore casing. As the cutting operation progresses and the depth of the cut increases, the cutting arms continue to rotate (pivot) radially outward so as to maintain the engagement of the cutting tips 86 with the wellbore casing. Those of ordinary skill in the art will understand that an axial translation of the tool body 82 in the downhole direction is also used in order to maintain engagement of the cutting tips 86 with the wellbore casing due to the pivoting action of the cutting arms. Achieving optimal stabilization can be particularly difficult with a wing-type (hinge-type) cutting tool 80, such as the one depicted on FIG. 1, because an axial translation of the cutting tool 80 is used during the cutting operation.

Referring to FIGS. 2 through 7, one or more example embodiments of the present disclosure are depicted. With respect to FIGS. 2 through 7, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 2 through 7 may be described herein with respect to that reference numeral shown on other views.

Figure 2:
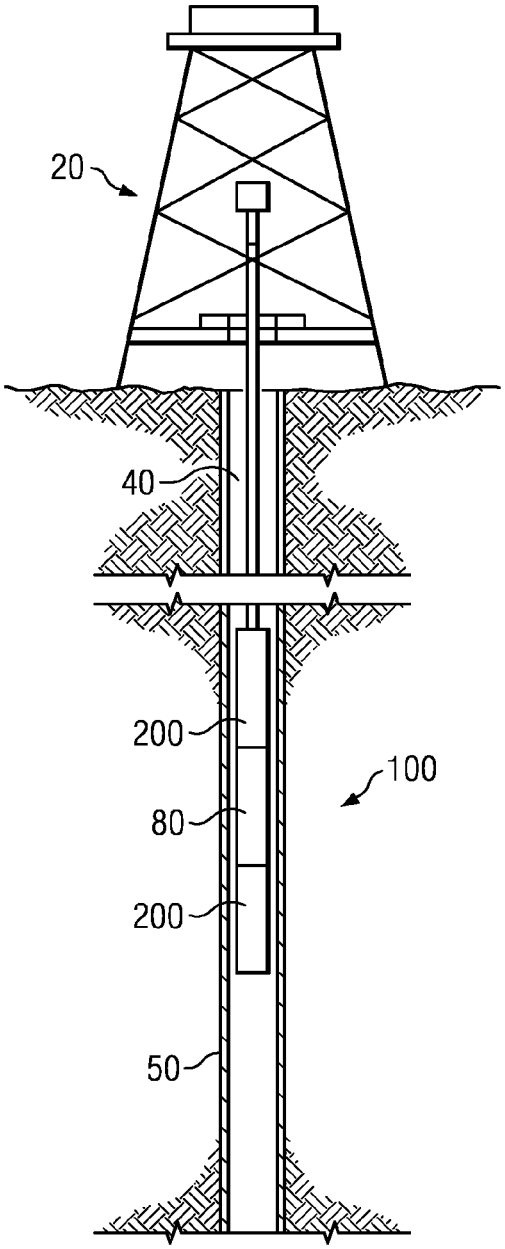
FIG. 2 depicts a conventional drilling rig on which example embodiments in accordance with the present disclosure may be utilized.

FIG. 2 depicts a downhole tool string 100, configured in accordance with one embodiment of the present disclosure, deployed in a cased wellbore 40. A rig 20 is positioned in the vicinity of a subterranean oil or gas formation. The rig may include, for example, a derrick and a hoisting apparatus for lowering and raising various components into and out of the wellbore 40. In the example embodiment depicted, the borehole 40 is at least partially cased with a string of metallic liners 50 (often referred to in the art as a wellbore casing string). The tool string 100 depicted includes first and second stabilizers 200 configured in accordance with embodiments of the present disclosure, and deployed axially about (above and below) a casing cutter 80. It will be understood that the string 100 may include other suitable components as needed for a particular downhole operation and that the present disclosure is not limited to any particular rig configuration, derrick, or hoisting apparatus. It will also be understood that the tool string 100 may be conveyed into the wellbore 40 using substantially any known means, for example only, including a string of connected drill pipe or coiled tubing. The present disclosure is also not limited to any particular means of conveyance.

Figure 3:
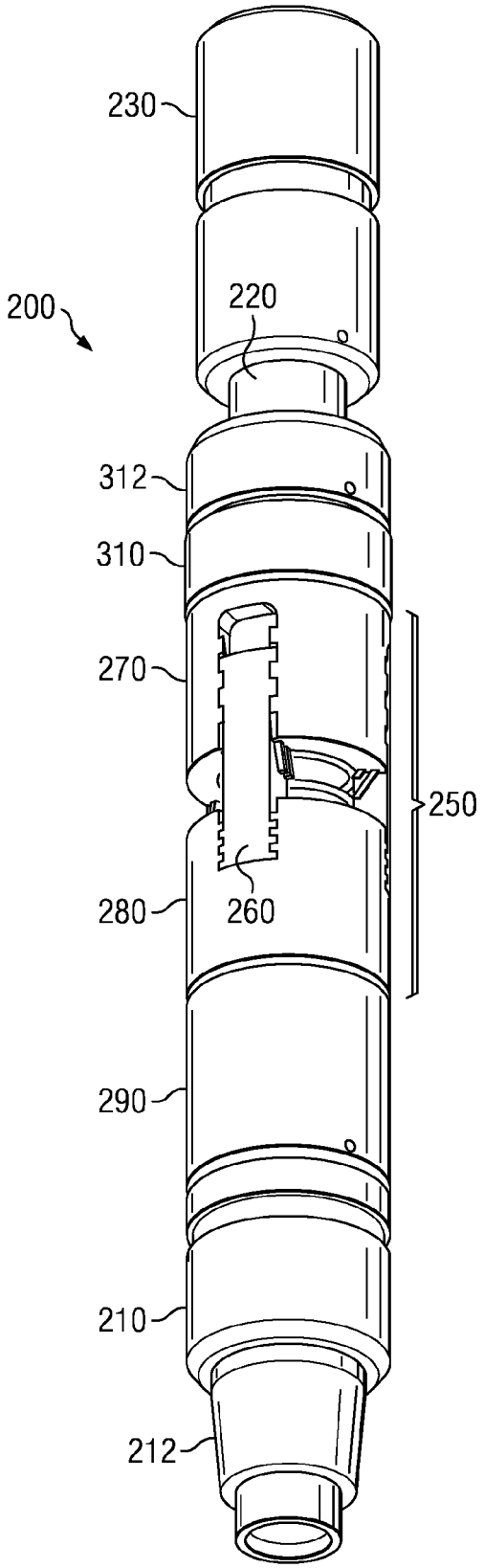
FIG. 3 is a perspective view of one example embodiment of a radial stabilizer in accordance with the disclosure herein.
Figure 4:
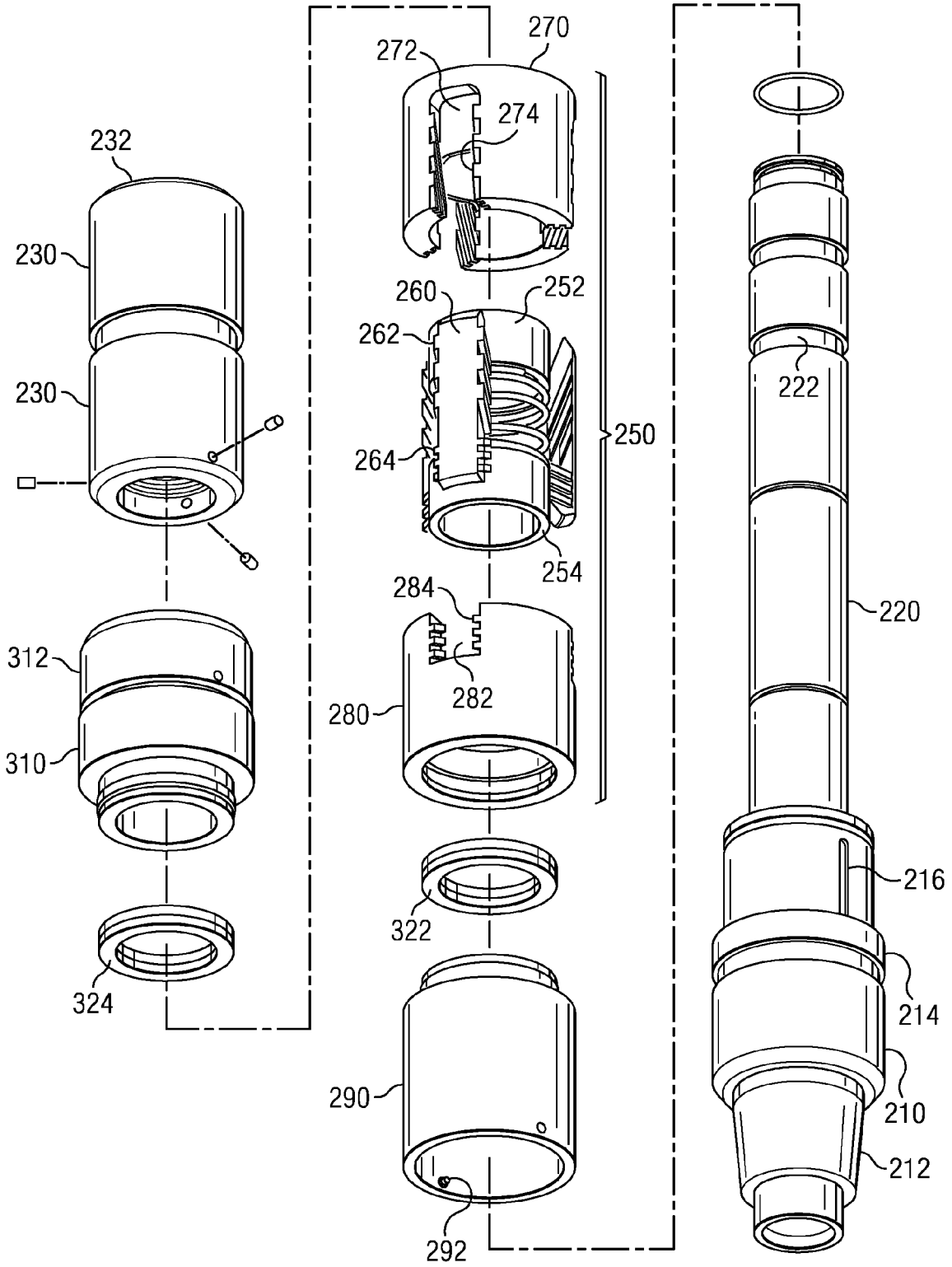
FIG. 4 is a partially exploded view of the stabilizer embodiment depicted on FIG. 3.

FIGS. 3 and 4 depict perspective and exploded views of one example embodiment of a radial stabilizer 200 in accordance with the disclosure herein. Radial stabilizer 200 includes a tool body 210 having a downhole threaded end portion 212 and an uphole mandrel portion 220. An upper connection 230 is coupled to an uphole end portion of the mandrel portion 220, for example, via a conventional threaded connection. As shown, upper connection 230 may include a threaded pipe connection 232, although other types of pipe connections are well-known to those skilled in the art and may be equally employed.

Radial stabilizer 200 further includes a radial expansion assembly 250 deployed about the mandrel 220. The expansion assembly 250 includes a plurality of stabilization blocks 260 that are deployed between uphole 270 and downhole 280 cones in corresponding axial slots 272, 282 formed in the cones. The blocks 260 are configured to extend radially outward into contact with the casing when drilling fluid is pumped through a central bore of the tool body 210 and to retract radially inward when the drilling fluid pressure is reduced below a predetermined threshold, as described in more detail below. The radial expansion assembly 250 is configured to generally remain rotationally stationary with respect to the wellbore, while the tool body 210 and other tool components are configured to rotate with the tool string.

Figure 5A:
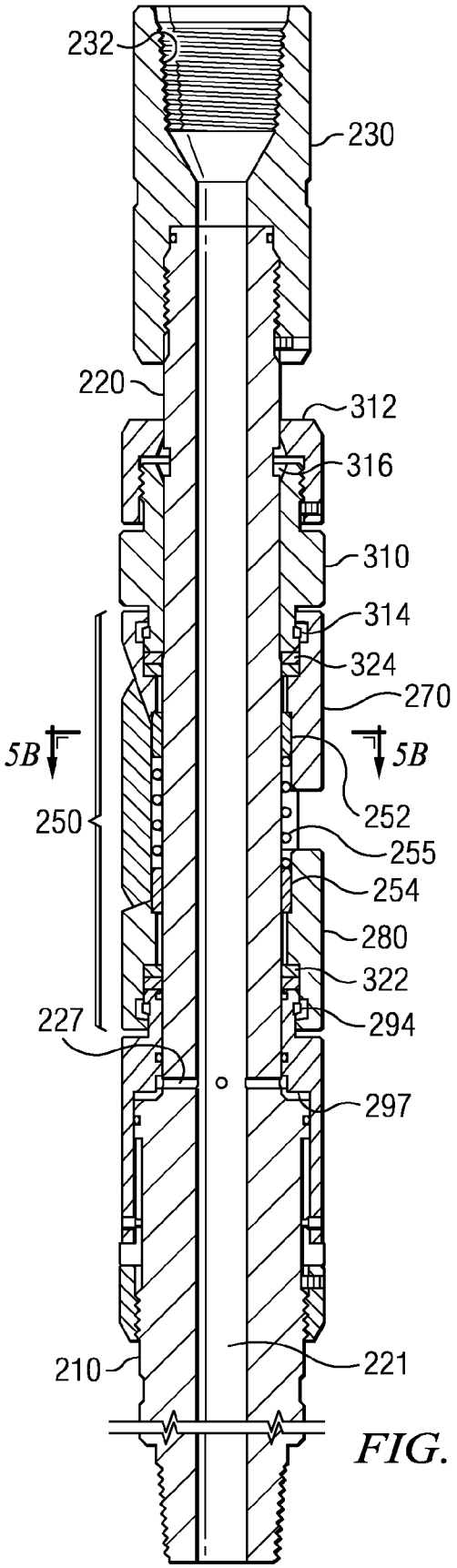
FIGS. 5A and 5B are longitudinal and circular cross-sectional views of the stabilizer of FIG. 3, with the stabilizer blocks in a collapsed position.
Figure 6A:
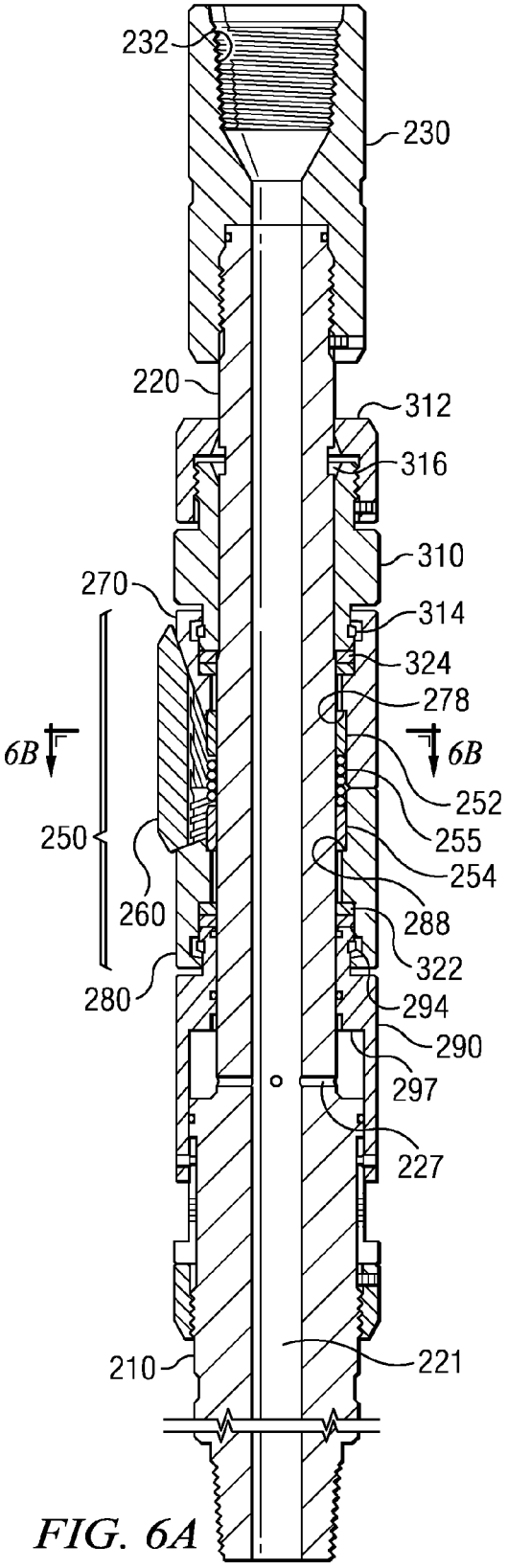
FIGS. 6A and 6B are longitudinal and circular cross-sectional views of the stabilizer of FIG. 3, with the stabilizer blocks in an extended position.

A piston 290 is deployed axially between the downhole cone 280 and a shoulder 214 of the tool body 210. The piston 290 is connected to body 210 via circumferentially spaced pins 292 which engage corresponding elongated grooves 216 formed in the body 210. Engagement of the pins 292 with the grooves 216 rotationally fixes the piston 290 to the tool body 210 (such that they rotate together) while allowing the piston 290 to reciprocate axially with respect to the tool body 210. The piston 290 and downhole cone 280 are connected to one another via snap ring 294 (FIGS. 5A and 6A). The snap ring 294 (FIGS. 5A and 6A) is intended to axially secure the piston 290 and cone 280 to one another while permitting relative rotation. Thrust bearings 322 are deployed axially between the piston 290 and downhole cone 280 and further provide for relative rotation.

Expansion assembly 250 is secured to the mandrel 220 via retainer 310 and cap 312. The retainer 310 and uphole cone 270 are connected to one another via snap ring 314 (FIGS. 5A and 6A). The snap ring 314 is intended to axially secure the retainer 310 and cone 270 to one another while permitting relative rotation. Thrust bearings 324 are deployed axially between the retainer 310 and the uphole cone 270 and further provide for relative rotation. As shown, the cap 312 is threaded to the retainer 310; however, other coupling mechanisms known to those skilled in the art may be employed. A crush ring 316 (FIGS. 5A and 6A) is tightened in a mandrel upset 222 between cap and retainer bevels thereby rotationally fixing the cap 312 and retainer 310 to the mandrel 220 (such that they rotate with the tool body 210). The crush ring 316 (FIGS. 5A and 6A) is also intended to prevent the cap 312 and retainer 310 from translating axially relative to the mandrel 220. The snap ring 314 connection between the retainer 310 and uphole cone 270 further prevents axial translation of the cone 270 with respect to the mandrel 220.

Expansion assembly 250 further includes an internal compression spring 255 deployed axially between radial bearings 252 and 254. Compression spring 255 is configured to bias the radial bearings 252 and 254 into contact with internal shoulders 278 and 288 (FIG. 6A) of cones 270 and 280. The spring 255 therefore biases the cones 270 and 280 in opposite axial directions (i.e., the uphole cone 270 is biased in the uphole direction while the downhole cone 280 is biased in the downhole direction), which in turn biases blocks 260 radially inward toward the mandrel 220. Radial bearings 252 and 254 further provide for rotation of the mandrel 220 in the cones 270 and 280.

As shown in FIG. 4, stabilization block 260 includes first and second sets of angled splines 262 and 264 formed on the lateral sides thereof. In the foregoing discussion, stabilization tool 200 is described with respect to a single stabilization block 260. It will be understood that tools in accordance with the present disclosure typically, although not necessarily, include multiple stabilization blocks. One or more embodiments include three axially aligned stabilization blocks circumferentially spaced at approximately 120 degree intervals about the tool body. Such a configuration centers the tool in the wellbore upon actuation of the stabilizer blocks. Other configurations may also be employed so as to center the tool in the wellbore. However, the claims and rest of the present disclosure are not limited to these described embodiments.

Splines 262 are sized and shaped to engage corresponding splines 274 formed in recess 272 of uphole cone 270. Splines 264 are sized and shaped to engage corresponding splines 284 in recess 282 of downhole cone 280. Interconnection between the splines 262 and 264 formed on the block 260 and the splines 274 and 284 formed on the cones 270 and 280 increases the surface area of contact between the block 260 and the cones 270 and 280 thereby typically providing a robust structure suitable for downhole stabilizing operations. By being angled, the splines 262, 264, 274, and 284 are not parallel with a longitudinal axis of the tool 200. Thus, relative axial motion between block 260 and cones 270 and 280 causes a corresponding radial extension or retraction of the block 260.

With continue reference to FIGS. 3 and 4, the first and second sets of splines 262 and 264 are orthogonal to one another. Stated another way, the sum of a first angle between splines 262 and a longitudinal axis of the tool body and a second angle between splines 264 and the longitudinal axis is about 90°. However, the angles between splines 262 and 264 and the longitudinal axis of the tool body may be selected so as to "tune" the clamping force of the stabilizer block with the cased wellbore. When used in combination with a wing-type casing cutter (e.g., as depicted on FIG. 1), the clamping force is high enough so as to provide sufficient radial stabilization but low enough so as to allow for axial slippage (translation) in the wellbore. Those of ordinary skill in the art will appreciate that a suitable range of clamping forces may depend on many factors, e.g., including, but not limited to, the differential pressure in the tool and the coefficient of friction between the stabilizer block and the casing string. Notwithstanding the above, it has been found that a suitable clamping force may generally be achieved when the angle between the first set of splines 262 and a longitudinal axis of the tool is in a range from about 10 to about 30°, more particularly from about 15° to about 25° and most particularly about 20°, and the angle between the second set of splines 264 and the longitudinal axis is in the range from about 60° to about 80°, more particularly from about 65° to about 75°, and most particularly about 70°.

It will be readily understood by those skilled in the art that other stabilizer design parameters may also be selected so as to tune the clamping force. By way of example and not limitation, the clamping force is influenced by the hydraulic force generated to move the one or more stabilizer blocks, the contact area of the stabilizer block, and the length of the stroke and the force used to initiate and complete the cut. In order to obtain an optimum clamping force for any particular cutting operation, the stabilizer design may be evaluated and optimized to obtain the desired force (or range of forces). The evaluation may include, for example, the generated hydraulic force applied to the one or more blocks, the component of the force applied to the cutters, and/or the frictional force between the stabilizer blocks and the casing. The claims and present disclosure are, of course, not limited to the aforementioned examples.

Figure 5B:
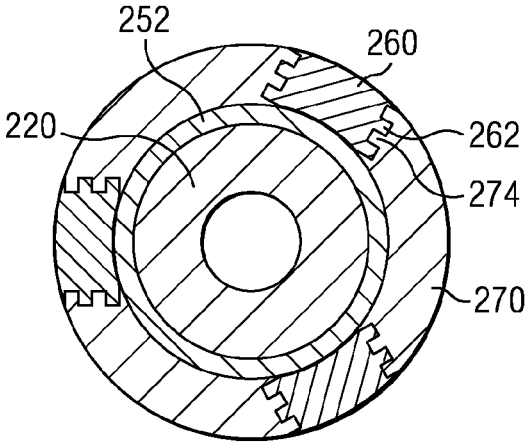
Figure 6B:
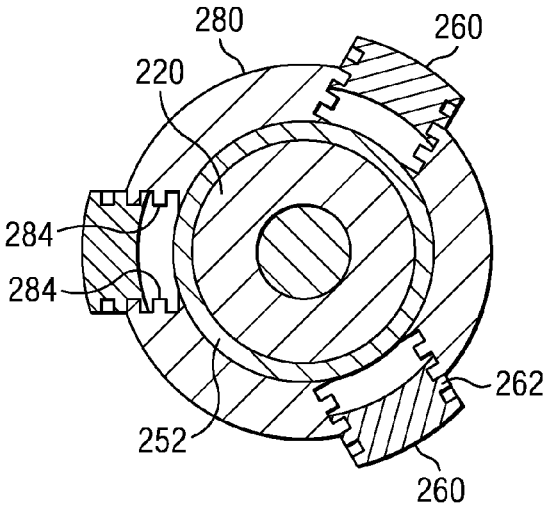

Actuation and deactuation of stabilizer 200 is now described in more detail with respect to FIGS. 5A, 5B, 6A and 6B. In FIGS. 5A and 5B, stabilizer 200 is depicted in a deactuated configuration in which stabilizer blocks 260 are retracted radially inward towards the mandrel 220. In FIGS. 6A and 6B, stabilizer 200 is depicted in a fully actuated configuration in which the stabilizer blocks 260 are substantially fully extended radially outward. In the absence of internal fluid pressure (e.g., a pressure differential between through bore 221 and an annular region external to the tool 200) compression spring 255 biases downhole cone 280 and piston 290 in the downhole direction such that pins 292 slide to a downhole end of groove 216. Translation of cone 280 retracts blocks 260 radially inward via engagement of splines 262 and 264 with splines 274 and 284. During a casing cutting operation, the tool string may be lowered into the wellbore with the stabilization blocks 260 retracted (as depicted on FIGS. 5A and 5B) thereby simplifying passage of the tool string through various restrictions.

Upon deploying the tool string at a desired location, the stabilization blocks 260 may be hydraulically actuated so as to radially stabilize the tool string in the wellbore. Such actuation may be initiated via the introduction of drilling fluid pressure to through bore 221 (e.g., via operation of mud pumps located at the surface). Fluid pressure is communicated to internal surface 297 of piston 290 via ports 227 formed in the mandrel 220. The fluid pressure urges the piston 290 and the downhole cone 280 in the uphole direction (i.e., towards uphole cone 270) against the spring bias. Translation of the downhole cone 280 in the uphole direction causes the expandable blocks to extend radially outward via engagement of splines 262 and 264 with splines 274 and 284. The blocks 260 are fully extended when downhole cone 280 contacts uphole cone 270 as depicted on FIG. 6A.

Figure 7:
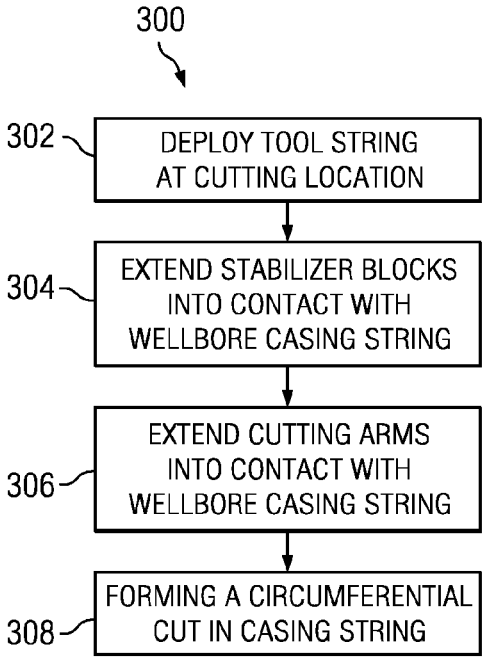
FIG. 7 is a flow chart of one example method embodiment in accordance with the disclosure herein.

FIG. 7 depicts a flow chart of one example embodiment of a method 300 for a casing cutting operation. At 302, a tool string, which includes a radial stabilizer 200 (according to one or more embodiments disclosed herein) and a wing-type casing cutter 80 (FIG. 1), is deployed in the wellbore at a predetermined cutting location. The stabilizer blocks are extended into contact with the casing string at 304, while the cutting arms are extended into contact with the casing string at 306. In one or more embodiments of the present disclosure, the stabilizer blocks and cutting arms are hydraulically actuated and extended substantially simultaneously, e.g., by pumping drilling fluid through the string of tools. At 308, a circumferential cut is formed in the casing string, for example, by rotating the string of tools (while the cutting arms are extended) in the wellbore. As the cutting operation progresses, the cutting arms continue to extend radially outward, which causes the tool string to translate axially in the wellbore. The stabilizer blocks are configured to provide a clamping force in a desired force range as described above so as to provide adequate radial stabilization with the blocks contacting the wellbore casing while at the same time allowing axial translation (slippage) of the tool string in the wellbore.

While the example embodiments of a radially expandable stabilizer are usable in combination with a conventional wing-type casing cutter (e.g., as depicted on FIG. 1), it will be understood that the present disclosure is not limited to any particular cutter. Generally, any type of casing cutter may be deployed in tool string 100. Cutting tools commonly include a plurality of arms that may be actuated to extend from the tool body and engage the casing. The arms commonly include a plurality of cutting elements, teeth, or inserts configured to engage and form a cut in the casing string upon rotation of the tool string. Actuation of the cutting arms may be hinge-like as described above with respect to FIG. 1 or purely radial. Moreover, any suitable actuation mechanism may be utilized, e.g., including, but not limited to, spring and hydraulic actuation. The present disclosure is not limited in any of these regards.

Although embodiments of the present disclosure have been described in detail, it should be understood that various changes, substitutions, and alterations may be made herein without departing from the spirit and scope of the disclosure as defined by the appended claims.

We claim:

1. A downhole tool, comprising:

a body configured to couple to a downhole tool string;

a first cone around at least a portion of the body, the first cone including a first cone recess having a set of first cone splines in at least one wall thereof, the first cone being configured to allow the at least a portion of the body to rotate substantially freely relative to the first cone;

a second cone around the at least a portion of the body, the second cone including a second cone recess having a set of second cone splines in at least one wall thereof, the second cone being configured to allow the at least a portion of the body to rotate substantially freely relative to the second cone; and a stabilizer block axially between the first and second cones and carried in the first and second cone recesses, the stabilizer block having a first set of stabilizer block splines configured to mate with the set of first cone splines, and a second set of stabilizer block splines configured to mate with the set of second cone splines, the stabilizer block being configured to allow the at least a portion of the body to rotate substantially freely relative to the stabilizer block.

2. The downhole tool of claim 1, the body including a mandrel.

3. The downhole tool of claim 2, the at least a portion of the body including the mandrel and the first cone, second cone, and stabilizer block being configured to rotate substantially freely relative to at least the mandrel.

4. The downhole tool of claim 1, the body defining a through bore.

5. The downhole tool of claim 4, the second cone being configured to translate axially with respect to the first cone in response to a differential pressure between the through bore and a region external to the body.

6. The downhole tool of claim 1, the set of first cone splines, set of second cone splines, first set of stabilizer block splines, and second set of stabilizer block splines each being angled with respect to a longitudinal axis of the body.

7. The downhole tool of claim 6, an angle between the first set of stabilizer block splines and the longitudinal axis being between about 10° and about 30°, and an angle between the second set of stabilizer block splines and the longitudinal axis being between about 60° and about 80°.

8. The downhole tool of claim 6, the first set of stabilizer block splines being orthogonal to the second set of stabilizer block splines.

9. The downhole tool of claim 6, the stabilizer block being configured to radially extend and retract as a result of axial translation of the second cone with respect to the first cone.

10. The downhole tool of claim 1, the stabilizer block being a first stabilizer block, and further comprising second and third stabilizer blocks, the first second, and third stabilizer blocks being angularly offset at angular intervals of about 120° about a circumference of at least a portion of the body.

11. The downhole tool of claim 1, further comprising:

a piston located axially between the second cone and a shoulder on the body, the piston being rotationally fixed to the body and configured to reciprocate axially with respect to the body.

12. The downhole tool of claim 11, the piston being configured to move axially with the second cone toward the first cone to move the stabilizer block radially outward.

13. The downhole tool of claim 12, at least one of the piston or the second cone being configured to move axially as a result of differential pressure in the body.

14. The downhole tool of claim 11, at least one of the piston or the second cone being biased axially in a direction opposite the first cone.

15. The downhole tool of claim 14, the stabilizer block being biased radially inward.

16. The downhole tool of claim 1, the first cone being axially fixed relative to the at least a portion of the body.

17. The downhole tool of claim 1, the body, first cone, second cone, and stabilizer block defining a downhole radial stabilizer, the downhole tool further comprising a casing cutting tool coupled to the downhole stabilizer.

18. The downhole tool of claim 17, the casing cutting tool being configured to move axially as cutting progresses during a casing cutting operation, and the downhole radial stabilizer being configured to provide radial stabilization while allowing the casing cutting tool to move axially.

19. The downhole tool of claim 17, the casing cutting tool and downhole radial stabilizer being configured to be simultaneously and hydraulically actuated, the casing cutting tool further including at least one radially extendable cutting arm configured to pivot radially outward about a hinge point.

20. The downhole tool of claim 17, the downhole radial stabilizer being a first downhole radial stabilizer, the downhole tool further including a second downhole radial stabilizer, the casing cutting tool being deployed axially between the first and second downhole radial stabilizers.

* * * * *